US008695260B2

(12) United States Patent
Kramer

(10) Patent No.: US 8,695,260 B2
(45) Date of Patent: Apr. 15, 2014

(54) CARTRIDGES AND MODIFICATIONS FOR M16/AR15 RIFLE

(76) Inventor: Lawrence S. Kramer, Mount Charleston, NV (US)

( * ) Notice: Subject to any disclaimer, the term of this patent is extended or adjusted under 35 U.S.C. 154(b) by 120 days.

(21) Appl. No.: 12/867,366

(22) PCT Filed: Feb. 13, 2009

(86) PCT No.: PCT/US2009/034096

§ 371 (c)(1),
(2), (4) Date: Aug. 12, 2010

(87) PCT Pub. No.: WO2009/137132

PCT Pub. Date: Nov. 12, 2009

(65) Prior Publication Data

US 2011/0005383 A1 Jan. 13, 2011

Related U.S. Application Data

(60) Provisional application No. 61/028,588, filed on Feb. 14, 2008.

(51) Int. Cl.
*F41A 3/12* (2006.01)

(52) U.S. Cl.
USPC ..... 42/69.02; 89/191.01

(58) Field of Classification Search
USPC ..... 42/25, 46, 106, 69.02, 68; 89/191.02, 89/191.01, 193
See application file for complete search history.

(56) References Cited

U.S. PATENT DOCUMENTS 3,713,386 A 1/1973 Zaid
3,776,095 A * 12/1973 Atchisson ..... 89/128
3,898,933 A 8/1975 Castera et al.
4,057,003 A * 11/1977 Atchisson ..... 89/138
4,440,062 A * 4/1984 McQueen ..... 89/128
5,033,386 A 7/1991 Vatsvog
5,351,598 A * 10/1994 Schuetz ..... 89/185
5,463,959 A 11/1995 Kramer
5,499,569 A 3/1996 Schuetz
5,520,019 A 5/1996 Schuetz
5,987,797 A 11/1999 Dustin
6,293,203 B1 9/2001 Alexander et al.
6,609,319 B1 8/2003 Olson
6,625,916 B1 * 9/2003 Dionne ..... 42/16

(Continued)

OTHER PUBLICATIONS

Chastain, R., "Hornady's New Ammo Loadings for 2007, A Mixture of New and Old Cartridges" about.com:hunting and shooting Apr. 5, 2007 [online], [retrieved on Oct. 14, 2009]. Retrieved from the Internet <URL:http://hunting.about.com/od/ammo/a/newhdyammo2007.htm>.

(Continued)

*Primary Examiner* — Benjamin P Lee
(74) *Attorney, Agent, or Firm* — Patterson & Sheridan, L.L.P.

(57) ABSTRACT

Embodiments of the present invention relate generally to cartridges and modifications for an M16/AR15 rifle. In one embodiment, a modified M16/AR15 rifle or carbine includes a bolt having a maximum outside diameter greater than that of a standard M16/AR15 bolt; and a bolt extractor pivoted to the bolt. The bolt and the bolt extractor are operable to: transport a cartridge from a magazine to a barrel, and eject a spent cartridge from the barrel. The rifle or carbine further includes a barrel extension configured to receive the bolt; a standard M16/AR15 upper receiver coupled to the barrel extension; a standard M16/AR15 lower receiver coupled to the upper receiver.

15 Claims, 20 Drawing Sheets

(56) References Cited

U.S. PATENT DOCUMENTS

| | | | | |
|---|---|---|---|---|
| 6,964,232 | B2 | 11/2005 | Eberhart et al. | |
| 7,739,939 | B2 * | 6/2010 | Adams | 89/191.01 |
| 7,779,743 | B2 | 8/2010 | Herring | |
| 7,971,382 | B2 * | 7/2011 | Robinson et al. | 42/75.02 |
| 7,971,518 | B2 * | 7/2011 | Adams | 89/191.01 |
| 7,975,595 | B2 * | 7/2011 | Robinson et al. | 89/185 |
| 8,069,600 | B2 * | 12/2011 | Rousseau et al. | 42/25 |
| 8,096,074 | B2 * | 1/2012 | Robinson et al. | 42/16 |
| 2003/0101891 | A1 | 6/2003 | Amick | |
| 2003/0131751 | A1 | 7/2003 | MacKerell et al. | |
| 2003/0213396 | A1 | 11/2003 | Dippold | |
| 2004/0074412 | A1 | 4/2004 | Kightlinger | |
| 2004/0255502 | A1 | 12/2004 | Jamison | |
| 2005/0066845 | A1 | 3/2005 | Eberhart et al. | |
| 2005/0211126 | A1 | 9/2005 | Hurley | |
| 2005/0262752 | A1 * | 12/2005 | Robinson et al. | 42/71.01 |
| 2006/0037464 | A1 * | 2/2006 | Moore | 89/125 |
| 2006/0065112 | A1 | 3/2006 | Kuczynko et al. | |
| 2006/0248773 | A1 | 11/2006 | Kightlinger | |
| 2007/0199435 | A1 | 8/2007 | Hochstrate et al. | |
| 2009/0211483 | A1 * | 8/2009 | Kramer | 102/439 |
| 2010/0281734 | A1 * | 11/2010 | Rousseau et al. | 42/25 |
| 2011/0094373 | A1 * | 4/2011 | Cassels | 89/191.01 |

OTHER PUBLICATIONS

International Search Report for Application No. PCT/US2009/034096 dated Oct. 21, 2009.

ANSI/SAAMI Z299.4-1992, Cartridge & Chamber, 223 Remington, p. 41, 1992.

Barnes, F. C.—"Cartridges of the World, Passage," Cartridges of the World, Jan. 1, 1972, XP-002049245, pp. 8, 10, 20, 46, 59, 66, 125-157, 177, 178.

Crist, Stan—"SSK 6.5mm MPC," Gun Buyer's Annual Presents #44, Special Weapons for Military and Police 2006, published by Harris Publications, Inc., New York, New York, 2006, pp. 64-67 and 89.

Gary's U.S. Infantry Weapons Reference Guide, Copyright 2004.

JGS, Rimless or Rebated Rifle Minimum Chamber, SAAMI 223 REM (5.56MM), Print #0517, May 8, 2002.

Johnston, Gary Paul—"The 6.8mm Remington SPC," Internet article dated Apr. 18, 2004, XP-002548838, <http://www.rifleshootermag.com/ammunition/remington_0303/>, pp. 1-4.

Johnston, Gary Paul—"The 6.8mm Rem SPC," Guns & Ammo Book of the AR-15, 2004, pp. 46-50, 52, 54, 56, and 57.

Kramer, Lawrence S. (inventor)—Appeal Brief filed Apr. 4, 2012, in U.S. Appl. No. 11/758,922.

Mushial, Gregory J.—223 Remington, Copyright 1997-2006.

Nischalke, Mike, Editor in Chief—"The R-15 and the .30 RAR, Remington Reinvents the Black Rifle," Shooting Times, Jun. 2009, pp. 34-41.

Roberts, Gary K.—"Time for a Change," U.S. Military Small Arms Ammunition Failures and Solutions, NDIA Dallas, Texas, May 21, 2008.

S.A.A.M.I. Technical Committee Manual, Section I—Characteristics, Center Fire Rifle, p. 1468.2, Jul. 6, 1962.

SAAMI Maximum Cartridge / Minimum Chamber 223 Remington Technical Drawings (date unknown).

Sierra Bullets, L.P.—"7mm TCU SSP," Sierra Reloading Manual, 5th Edition, 2003, pp. 884, 887, 889, and 890.

Sierra Bullets, L.P.—Rifle Reloading Data: 6×45mm and 6×47mm, Sierra Reloading Manual 5th Edition, published by Sierra Bullets, Sedalia, Missouri, 2003, pp. 281 and 285.

SSK Industries, "300 Whisper," SSK Industries, Wintersville, Ohio, date unknown, 4 pages.

The Reload Bench—"7mm TCU," Internet article dated May 8, 2011, <http://www.reloadbench.com/cartridges/w7mmtcu.html>.

Williams, Anthony G.—"More Punch for the AR-15," Internet article dated Feb. 1996, XP-002548730, <http://www.quarry .nildram.co.uk/AR15bigbore.htm>, pp. 1-3.

Ken Elmore, Specialized Armament 2008, M16: M4: AR-15 Armorer Course, 5 pages.

Illustrated Parts Catalog, Colt Manual No. RM202, Rev A.05, 2005, 2 pages.

* cited by examiner

| CARTRIDGE | DIMENSIONS (inches or deg.) | | | | | | | | | | | | |
|---|---|---|---|---|---|---|---|---|---|---|---|---|---|
| | A | B | C | D | E | F | G | H | I | a | NL (APX) | NW | COL (MAX) |
| FIG. 1A | | | | | | | | | | | | | |
| 5.7 mm / 224 cal. | 1.700 | 1.500 | 1.250 | .150 | .254 | .254 | .454 | .470 | .473 | 20 | .200 | .0165 | 2.260 |
| | | | | | | | | | | | | | |
| 6 mm / 243 cal. | 1.700 | 1.500 | 1.250 | .150 | .276 | .276 | .454 | .470 | .473 | 20 | .200 | .0165 | 2.260 |
| | | | | | | | | | | | | | |
| 6.5 mm / 264 cal. | 1.700 | 1.500 | 1.270 | .150 | .297 | .297 | .454 | .470 | .473 | 20 | .200 | .0165 | 2.260 |
| | | | | | | | | | | | | | |
| 6.8 mm / 277 cal. | 1.700 | 1.500 | 1.295 | .150 | .308 | .308 | .454 | .470 | .473 | 20 | .200 | .0155 | 2.260 |
| | | | | | | | | | | | | | |
| 7.62 mm / 308 cal. | 1.700 | 1.500 | 1.325 | .150 | .343 | .343 | .454 | .470 | .473 | 20 | .200 | .0175 | 2.260 |
| | | | | | | | | | | | | | |
| 8.6 mm / 338 cal. | 1.700 | 1.500 | 1.325 | .150 | .364 | .364 | .454 | .470 | .473 | 20 | .200 | .0130 | 2.260 |
| FIG. 1B | | | | | | | | | | | | | |
| 440 KINETIC (430 cal.) | 1.750 | N/A | N/A | .150 | .454 | N/A | N/A | .470 | .473 | N/A | N/A | .012 | 2.200 |
| | | | | | | | | | | | | | |
| 440 ENTRY (Buckshot) | 1.750 | N/A | N/A | .150 | .454 | N/A | N/A | .470 | .473 | N/A | N/A | .012 | 2.200 |

FIG. 1C

| DIMENSION | Std. M16/AR15 Bolt | Modified Bolt |
|---|---|---|
| | (inches) | |
| A | 2.800 | 2.800 |
| B | 0.510 | 0.510 |
| C | 0.280 | 0.280 |
| D | 0.120 | 0.120 |
| E | 0.178 | 0.155 |
| F | 0.102 | 0.105 |
| G | 0.106 | 0.106 |
| H (Diam.) | 0.528 | 0.577 |
| I (diam.) | 0.382 | 0.477 |
| J | 0.073 | 0.050 |
| K | 0.740 | 0.787 |
| L | 0.250 | 0.250 |
| M | 0.254 | 0.315 |
| N | 0.465 | 0.465 |
| O | .0.250 | 0.250 |
| P | 0.548 | 0.595 |
| Q | 0.930 | 0.930 |
| R | 2.155 | 2.155 |
| S | 0.645 | 0.645 |
| T | 0.140 | 0.140 |

FIG. 3E

| DIMENSION | Std. M16/AR15 Bolt Extractor | Modified Bolt Extractor |
|---|---|---|
| | (inches) | |
| A | 1.240 | 1.240 |
| B | N/A | 0.450 |
| C | 0.275 | 0.275 |
| D | N/A | 0.042 |
| E | 0.090 | 0.090 |
| F | 0.244 | 0.305 |
| G | 0.065 | 0.072 |
| H | 0.240 | 0.240 |

FIG. 4E

| DIMENSION | Std. M16/AR15 Barrel Extension | Modified Barrel Extension |
|---|---|---|
| | (inches) | |
| A | 1.168 | 1.168 |
| B | 0.134 | 0.134 |
| C | 0.998 | 0.998 |
| D | 0.989 | 0.989 |
| E | 1.122 | 1.122 |
| F | 0.120 | 0.096 |
| G | 0.128 | 0.128 |
| H | 0.998 | 0.998 |
| I | 0.760 | 0.807 |
| J | 0.575 | 0.620 |
| K | 0.110 | 0.114 |
| L | 0.168 | 0.186 |

FIG. 5D

| DIMENSION | 5.7 - 6.5 mm ERC | 6.8 - 8.6 mm ERC | 440 K & E |
|---|---|---|---|
| | FIGS. 6A-C | | FIGS. 6D-6F |
| | (inches or degrees) | | |
| A | 2.520 | 2.520 | 2.520 |
| B | .890 | .890 | .890 |
| C | 1.600 | 1.600 | 1.600 |
| D | .980 | .980 | .980 |
| E | .360 | .360 | .360 |
| F | .135 | .105 | .045 |
| G | .045 | .045 | .045 |
| H | 6.300 | 6.300 | 7.25 |
| I | 7.250 | 7.250 | 7.250 |
| J | 1.485 | 1.485 | 1.485 |
| K | .480 | .480 | .480 |
| L | 1.050 | 1.050 | 1.050 |
| M | 11 | 11 | N/A |

FIG. 6G

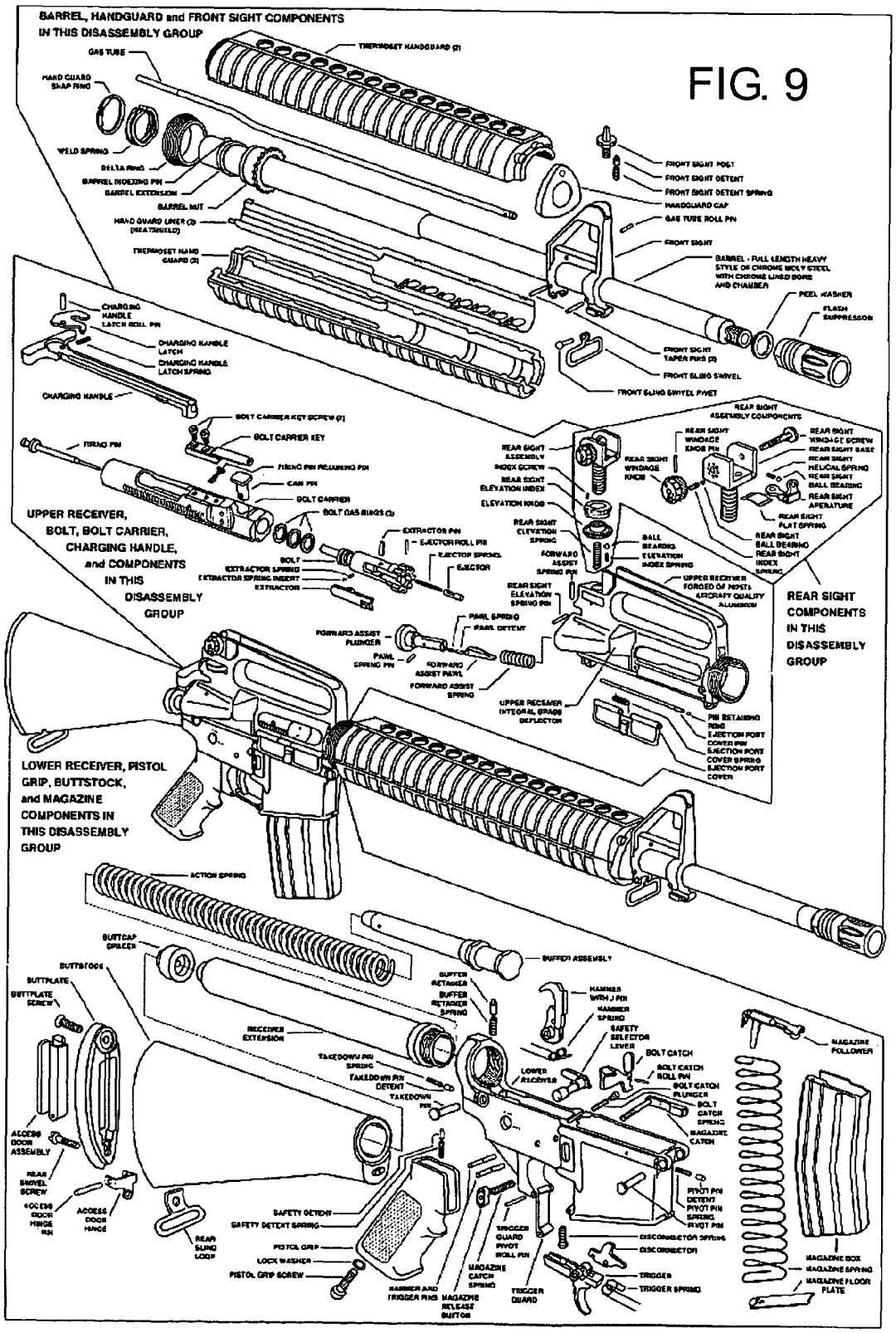
BARREL, HANDGUARD and FRONT SIGHT COMPONENTS IN THIS DISASSEMBLY GROUP
FIG. 9
GAS TUBE
HAND GUARD SNAP RING
WELD SPRING
DELTA RING
BARREL INDEXING PIN
BARREL EXTENSION
BARREL NUT
HAND GUARD LINER (2)
THERMOSET HAND GUARD (2)
THERMOSET HANDGUARD (2)
FRONT SIGHT POST
FRONT SIGHT DETENT
FRONT SIGHT DETENT SPRING
HANDGUARD CAP
GAS TUBE ROLL PIN
FRONT SIGHT
BARREL - FULL LENGTH HEAVY STYLE OF CHROME MOLY STEEL WITH CHROME LINED BORE AND CHAMBER
PEEL WASHER
FLASH SUPPRESSOR
FRONT SIGHT TAPER PINS (2)
FRONT SLING SWIVEL
FRONT SLING SWIVEL PIVOT
CHARGING HANDLE LATCH ROLL PIN
CHARGING HANDLE LATCH
CHARGING HANDLE LATCH SPRING
CHARGING HANDLE
BOLT CARRIER KEY SCREW (2)
BOLT CARRIER KEY
FIRING PIN
FIRING PIN RETAINING PIN
CAM PIN
BOLT CARRIER
BOLT GAS RINGS (3)
UPPER RECEIVER, BOLT, BOLT CARRIER, CHARGING HANDLE, and COMPONENTS IN THIS DISASSEMBLY GROUP
EXTRACTOR PIN
EJECTOR ROLL PIN
EJECTOR SPRING
EJECTOR
BOLT
EXTRACTOR SPRING
EXTRACTOR SPRING INSERT
EXTRACTOR
REAR SIGHT ASSEMBLY COMPONENTS
REAR SIGHT ASSEMBLY
INDEX SCREW
REAR SIGHT ELEVATION INDEX
ELEVATION KNOB
REAR SIGHT ELEVATION SPRING
REAR SIGHT WINDAGE KNOB
REAR SIGHT WINDAGE KNOB PIN
REAR SIGHT WINDAGE SCREW
REAR SIGHT REAR SIGHT BASE
REAR SIGHT HELICAL SPRING
REAR SIGHT BALL BEARING
REAR SIGHT APERATURE
REAR SIGHT FLAT SPRING
REAR SIGHT BALL BEARING
REAR SIGHT INDEX SPRING
BALL BEARING
ELEVATION INDEX SPRING
FORWARD ASSIST SPRING PIN
UPPER RECEIVER FORGED OF MIL-STD AIRCRAFT QUALITY ALUMINUM
REAR SIGHT ELEVATION SPRING PIN
REAR SIGHT COMPONENTS IN THIS DISASSEMBLY GROUP
PAWL SPRING
PAWL DETENT
FORWARD ASSIST PLUNGER
PAWL SPRING PIN
FORWARD ASSIST PAWL
FORWARD ASSIST SPRING
UPPER RECEIVER INTEGRAL GRASS DEFLECTOR
PIN RETAINING RING
EJECTION PORT COVER PIN
EJECTION PORT COVER SPRING
EJECTION PORT COVER
LOWER RECEIVER, PISTOL GRIP, BUTTSTOCK, and MAGAZINE COMPONENTS IN THIS DISASSEMBLY GROUP
ACTION SPRING
BUFFER ASSEMBLY
BUTTCAP SPACER
BUTTSTOCK
BUTTPLATE
BUTTPLATE SCREW
BUFFER RETAINER
BUFFER RETAINER SPRING
HAMMER WITH J PIN
HAMMER SPRING
SAFETY SELECTOR LEVER
RECEIVER EXTENSION
TAKEDOWN PIN SPRING
TAKEDOWN PIN DETENT
TAKEDOWN PIN
LOWER RECEIVER
BOLT CATCH
BOLT CATCH ROLL PIN
BOLT CATCH PLUNGER
BOLT CATCH SPRING
MAGAZINE CATCH
MAGAZINE FOLLOWER
ACCESS DOOR ASSEMBLY
REAR SWIVEL SCREW
ACCESS DOOR HINGE PIN
ACCESS DOOR HINGE
REAR SLING LOOP
SAFETY DETENT
SAFETY DETENT SPRING
PISTOL GRIP
LOCK WASHER
PISTOL GRIP SCREW
HAMMER AND TRIGGER PINS
MAGAZINE RELEASE BUTTON
MAGAZINE CATCH SPRING
TRIGGER GUARD PIVOT ROLL PIN
TRIGGER GUARD
PIVOT PIN DETENT
PIVOT PIN SPRING
PIVOT PIN
DISCONNECTOR SPRING
DISCONNECTOR
TRIGGER
TRIGGER SPRING
MAGAZINE BOX
MAGAZINE SPRING
MAGAZINE FLOOR PLATE

CARTRIDGES AND MODIFICATIONS FOR M16/AR15 RIFLE

This application is a national stage of International Application No. PCT/US09/34096, filed Feb. 13, 2009, which claims priority to the U.S. Provisional No. 61/028,588, filed Feb. 14, 2008.

BACKGROUND OF THE INVENTION

1. Field of the Invention

Embodiments of the present invention relate generally to cartridges and modifications for an M16/AR15 rifle.

2. Description of the Related Art

Domestic Law Enforcement Needs

Most domestic law enforcement agencies in the United States utilize the AR15/M16 rifle platform in the course of their daily duties, as patrol officers out on the street; it is often referred to as a "patrol carbine" and is carried by individual officers. These rifles are also used by SWAT teams for room entry or close quarter's battle (CQB) for close in shooting, and are used by some departments as short range sniper rifles. The reasons for the selection of this rifle platform are that they are readily available in many configurations and are fairly reasonably priced to Law Enforcement agencies, the AR15's weight and size are also attractive features of the AR15 as they are easily operable by large men and smaller stature women. The limiting factor is the cartridge that it fires, the 223 Remington, most commonly using a 55 grain bullet. Domestic law enforcement is not held to the military restriction of using full metal jacket projectiles and therefore can choose from a wide variety of available bullet styles and designs, which makes the 223 Remington more effective.

Even with the proper selection of ammunition, the 223 Remington is still substandard for most law enforcement applications and has a well known reputation for "over penetration" with it's small-fast bullet. This can result in extremely dangerous situations for patrol officers working in a built up urban environment. The small weight or mass of the bullet makes it less effective and more prone to deflection on vehicles when engaged by police, especially when engaging thick windshield glass. Although there are a few "alternate" cartridges available that will function in the AR15 rifle, they do not offer enough of an improvement over the existing .223 Remington cartridge chambering to justify the cost in switching over to them, mainly cost and availability of ammunition and magazines. Thus the agencies are limited on their choices of cartridge choices if they maintain the AR15/M16 rifle platform as their weapon of choice.

The other choice for law enforcement agencies is the larger and more costly AR15 "style" rifle made by various companies that fire the .308 Winchester cartridge. The .308 Winchester is a powerful cartridge and offers a substantial improvement over the much smaller .223 Remington chambering. Most police sniper rifles are chambered in the .308 Winchester and are bolt action guns, which do not allow for quick follow up shots if needed.

When quick follow up shots are required the larger AR15 style rifles are sometimes used, they are heavier and have more recoil than the smaller rifles, but deliver ample firepower when needed. These heavier and larger rifles are not the preferred option for SWAT teams for use in room entry and building clearing operations because the power of the 308 Winchester is too much for inside building operations, due to muzzle blast, recoil, and over penetration.

These two calibers represent not only the two most popular calibers used in law enforcement but are the two extremes, with the 223 Remington not providing enough performance or power and the 308 Winchester providing too much or excessive power.

United States Military Needs

The existing standard cartridge or chambering for the military's M16 rifle is the .223 Remington or 5.56 mm NATO (military designation) cartridge. It fires a .224 caliber bullet weighing 62 grains in the military issue M855 ammunition. Bullets weighing as much as 77 grains are currently in use by the US military to increase the performance of the 5.56 mm NATO cartridge and have increased the terminal performance of the cartridge, but its terminal effects are still less than desirable for what is considered an adequate combat cartridge. The shortcomings in the performance of the 5.56 mm NATO cartridge are well documented in current and past military conflicts, and the cartridge's ineffectiveness is more pronounced when the enemy combatants are under the influence of drugs that affect the central nervous system.

An alternative for heavier machine guns is the .308 or 7.62 mm caliber bullet. The most common military caliber utilizing the .308 or 7.62 mm caliber bullet is the 308 Winchester or 7.62 mm NATO cartridge. The performance of the 7.62 NATO is also well documented in combat and is known for its increased stopping power. The U.S. M14 rifle fires the 7.62 mm NATO cartridge as does the U.S. M240 machinegun, as well as several aircraft mounted machineguns and the minigun. The AK47 also utilizes a 7.62 mm bullet.

What is needed is a cartridge that will provide improved stopping power without over penetrating, and is compatible with the standard size M16/AR15 rifle platform.

SUMMARY OF THE INVENTION

Embodiments of the present invention relate generally to cartridges and modifications for an M16/AR15 rifle. In one embodiment, a modified M16/AR15 rifle or carbine includes a bolt having a maximum outside diameter greater than that of a standard M16/AR15 bolt; and a bolt extractor pivoted to the bolt. The bolt and the bolt extractor are operable to: transport a cartridge from a magazine to a barrel, and eject a spent cartridge from the barrel. The rifle or carbine further includes a barrel extension configured to receive the bolt; a standard M16/AR15 upper receiver coupled to the barrel extension; a standard M16/AR15 lower receiver coupled to the upper receiver.

In another embodiment, a cartridge includes a bullet having a diameter greater than or equal to 0.224 inch; and a case having a case head diameter greater than or equal to 0.45 inch. A length of the cartridge is substantially equal to 2.26 inches.

In another embodiment, a firearm includes a barrel. The firearm further includes a bolt operable to transport a cartridge from a magazine to the barrel and eject the spent cartridge from the barrel. The firearm further includes a spring biasing the bolt toward the barrel and a piston system in fluid communication with the barrel. The piston system includes a body and a piston disposed in the body and operable to move the bolt away from the barrel in response to firing of the cartridge and force exhaust gas from the body and into the barrel in response to the spring returning the bolt to the barrel.

BRIEF DESCRIPTION OF THE DRAWINGS

So that the manner in which the above recited features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

FIGS. 1A-1C illustrate cartridges, according to embodiments of the present invention.

FIGS. 3A-3E illustrate details of the bolt of FIG. 2.

FIGS. 4A-4E illustrate details of the bolt extractor of FIG. 2.

FIGS. 5A-5D illustrate details of the barrel extension of FIG. 2.

FIGS. 6A-6G illustrate details of a magazine usable with the cartridges of FIGS. 1A-1C.

FIG. 9 is an exploded assembly of a prior art M16/AR15.

DETAILED DESCRIPTION OF THE PREFERRED EMBODIMENT

Figure 1A:
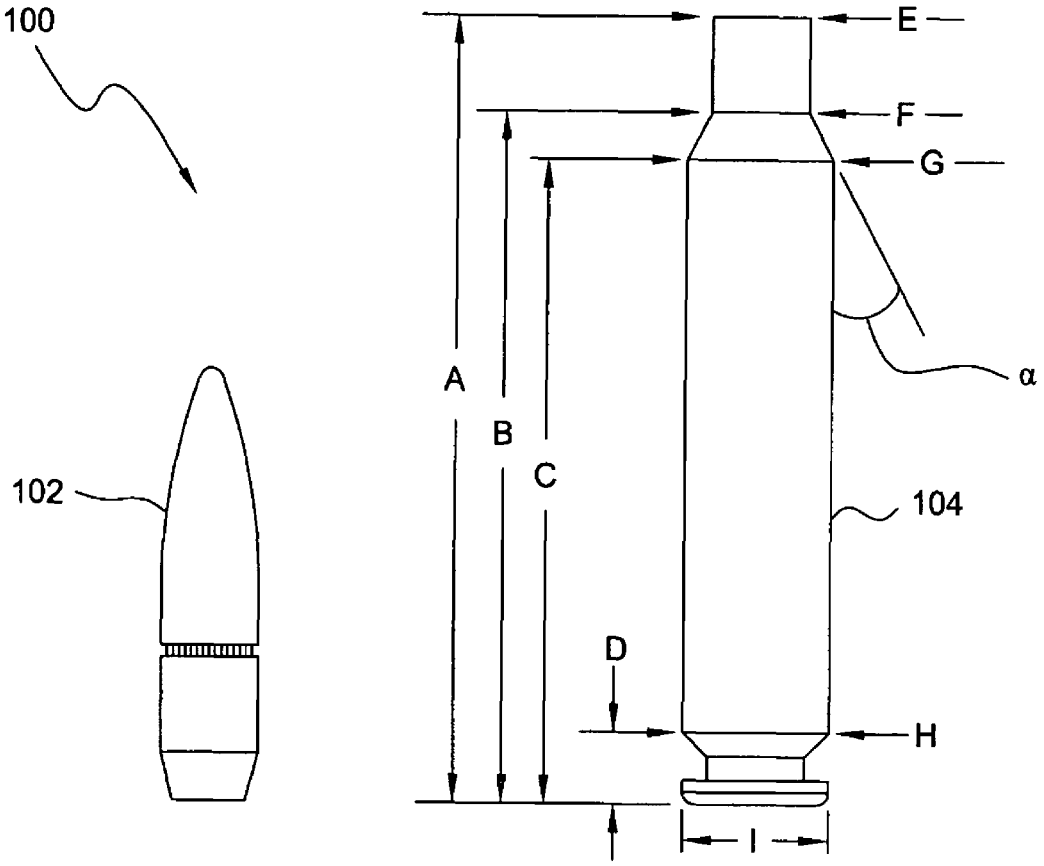
Figure 1B:
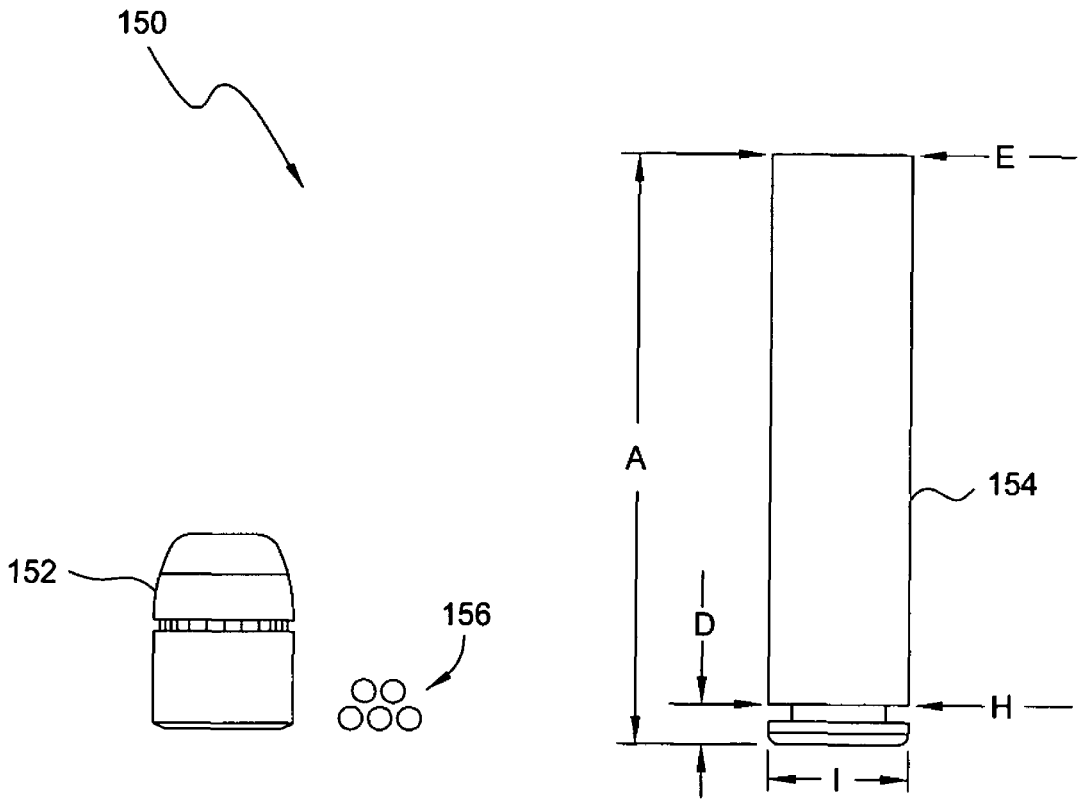

FIGS. 1A-1C illustrate cartridges, according to embodiments of the present invention.

The 308 ERC was designed to maximize the performance of the AR15/M16 rifle, give it more stopping or incapacitation power and increase its performance in self defense, law enforcement, and military combat applications. The 308 ERC is based on the .308 Winchester or 7.62 mm NATO cartridge, utilizes the 308 caliber bullet, and is designed to operate in the existing standard issue sized AR15/M16 rifle platform.

Cartridge Details;

Case head diameter; 0.473" inches (a 25% increase over the 223 Remington/5.56 NATO)

NL is an abbreviation for neck length. NW is an abbreviation for neck wall. COL is an abbreviation for cartridge overall length.

Powder capacity; 52% increase over the 223 Remington/5.56 NATO & 18% less than the 308 Winchester Projected design performance data;

Bullet weight: 135-140 grains

Muzzle velocity: 2650 feet per second (fps) (16" barreled AR15/M16 carbine)

Muzzle energy: 2106 foot pounds

Muzzle energy increase: 82% (compared to military current issue M855 62 grain FMJBTWC@2900 fps fired from a 16" barreled AR15/M16 carbine)

Figure 2:
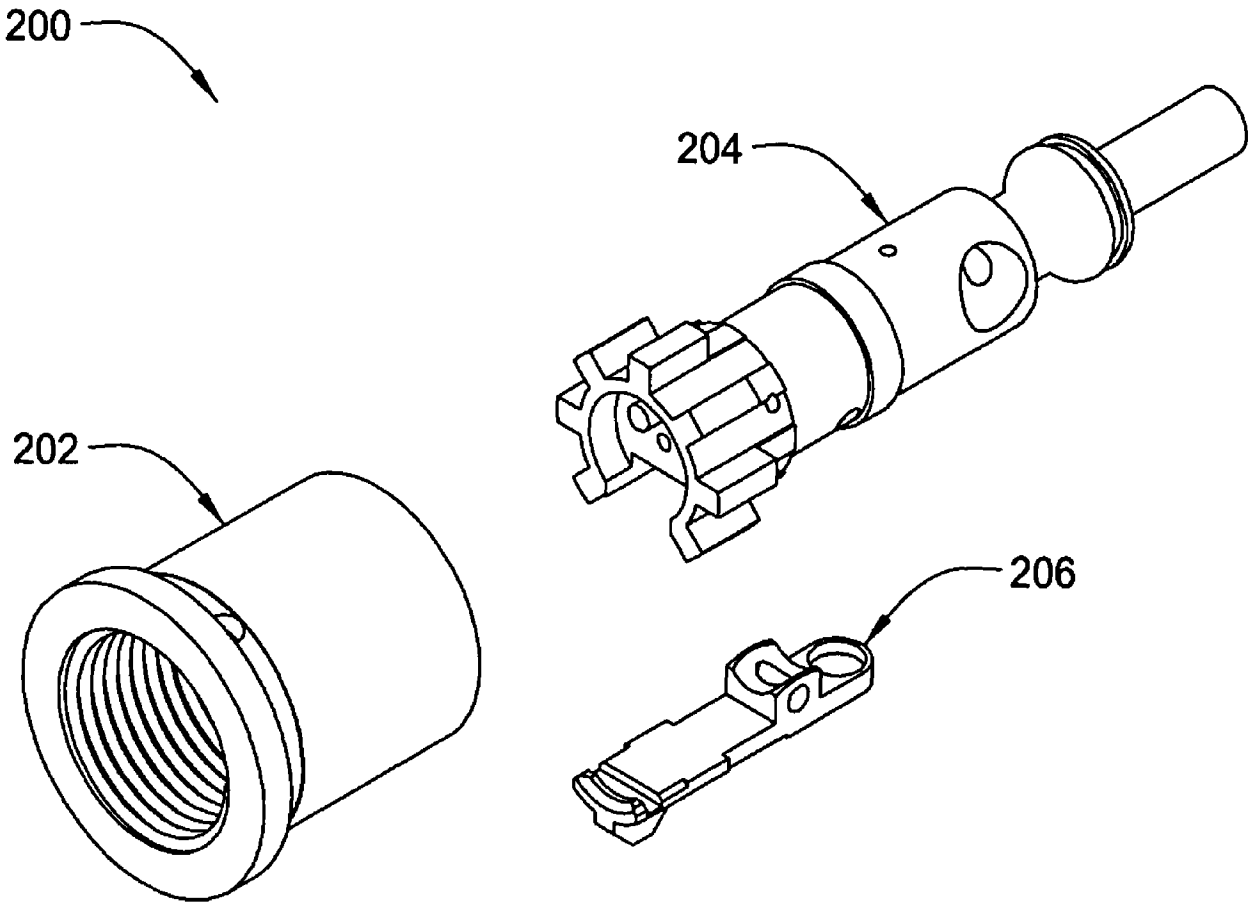
FIG. 2 is an exploded assembly of a bolt, bolt extractor, and barrel extension usable with the cartridges of FIGS. 1A-1C.

FIG. 2 is an exploded assembly of a bolt, bolt extractor, and barrel extension usable with the cartridges of FIGS. 1A-1C. Although the cartridge is designed to operate in the AR15/M16 platform, the following design changes were required (in addition to modification of the barrel);

204-ERC redesigned bolt

206-ERC redesigned bolt extractor

202-ERC redesigned barrel extension

FIG. 6A-6G-ERC redesigned magazines, 25 round capacity

Additional ERC cartridges:

Although any of these cartridges utilizing the ERC case can be used for self defense or law enforcement applications, their projected use is listed below;

224 caliber/5.7 mm—varmint hunting, rifle competition 243 caliber/6 mm—varmint hunting, rifle competition 264 caliber/6.5 mm—varmint hunting, rifle competition 270 caliber/6.8 mm—military, law enforcement, hunting 308 caliber/7.62 mm—military, law enforcement, hunting 338 caliber/8.6 mm—military, law enforcement, hunting 440 KINETIC—military, law enforcement, door & wall breeching, hunting 440 ENTRY (buckshot)—military, law enforcement, door & wall breeching, room entry (CQB), hunting. The barrel may be smooth bore or rifled for the 440 ENTRY.

The bullets may have hollow points and may have full metal jackets or be semi-jacketed (lead tip).

FIGS. 7A-7D illustrate details of a bolt usable with the cartridges of FIGS. 1A-1C and a modified gas piston system (see FIG. 8), according to another embodiment of the present invention. All dimensions are in inches.

Figure 8:
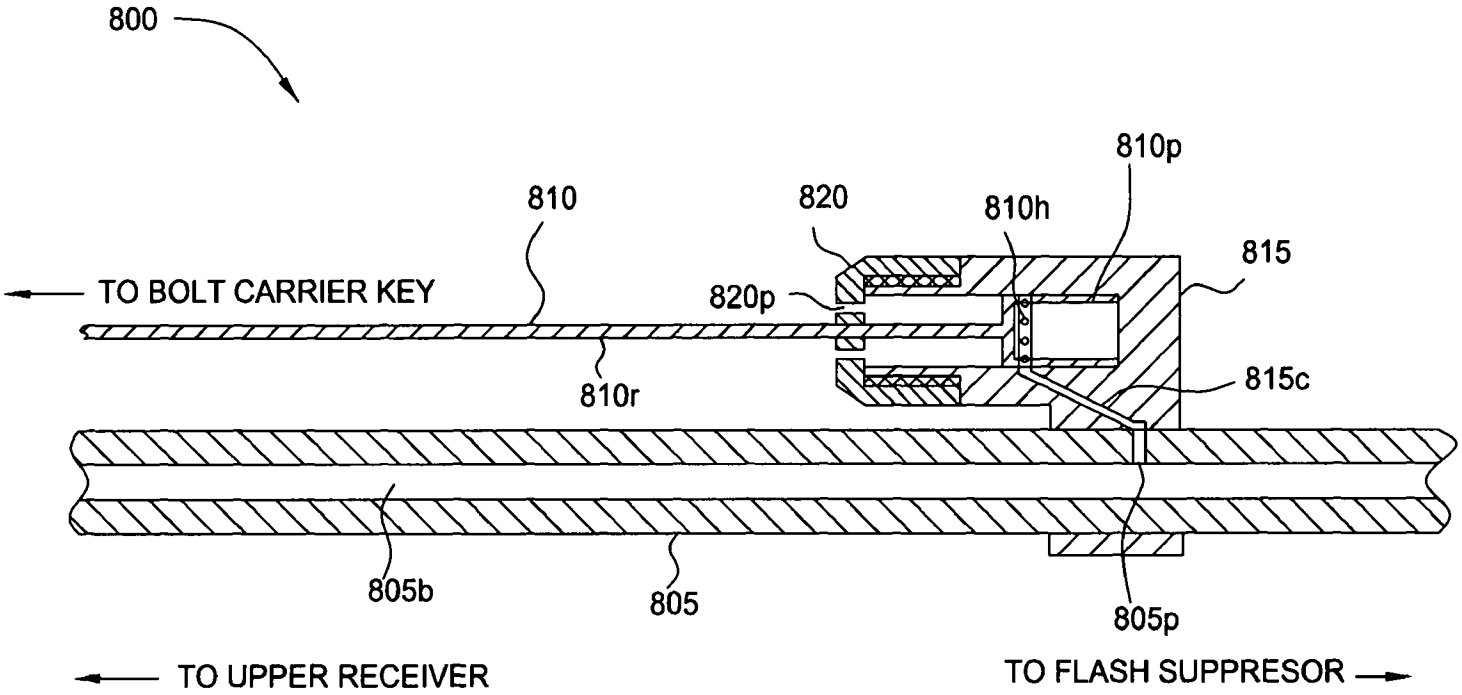
FIG. 8 is a cross section of a gas piston system, according to another embodiment of the present invention.

FIG. 8 is a cross section of a gas piston system 800, according to another embodiment of the present invention.

The use of gas piston systems in weapons to cycle the action is used in weapons such as the Russian AK 47 (1947), the U.S M1 Garand (1939) and the U.S. M14 (1957). There are as many as five gas piston systems currently manufactured for the AR15 rifle by various companies. They use a gas piston actuated by "tapped gas" from the fired cartridge via a small hole or "gas port" in the barrel, the expanding gas forces the piston to move. As such, the gas from a fired cartridge is utilized to cycle the action and load the next cartridge. The expanding gas from the fired cartridge, once utilized to cycle the piston, is then vented out of the gas manifold at the end of the piston operating stroke before the piston returns to the starting position.

The standard design gas system used in AR15 and M16 rifles utilizes a "direct gas impingement system" which directs expanding gas from the fired cartridge out of the barrel through a "gas port" or hole in the barrel. The expanding "tapped gas" is then directed through a "gas tube" which "directs" the gas back into the upper receiver. The gas then enters the "bolt carrier key" forcing the carrier to the rear and unlocking the bolt of the rifle, beginning the cycling process.

The gas piston system 800 may include a barrel 805, a piston/rod assembly 810, a gas block 815, and a gas block cap 820. The gas block 815 may have a bore formed therethrough, may be disposed around the barrel 805, and secured to the barrel 805 with fasteners (not shown), such as screws or pins. The gas block 815 may have a piston chamber formed therein. A piston 810*p* of the piston/rod assembly 810 may be disposed in the piston chamber. The piston 810*p* may divide the chamber into an air sub-chamber and an exhaust sub-chamber. The piston 810*p* may be longitudinally coupled to a rod 810*r* of the piston/rod assembly 810, such as by being formed integrally therewith or welded thereto. The piston 810*p* may include an array of carbon grooves (not shown) formed around an outer surface thereof. The cap 820 may be coupled to the gas block 815 by a threaded connection. The rod 810*r* may extend through a bore formed through the cap 820. The cap may have one or more ports 820*p* formed therethrough and providing air communication between air sub-chamber and the atmosphere. The gas block 815 may have a channel 815*c* formed between the chamber and the bore and providing fluid communication between the exhaust sub-chamber and a port 805*p* formed through a wall of the barrel 805. The port 805*p* may provide fluid communication between a bore 805*b* of the barrel 805 and the channel 815*c*. The bore 805*b* barrel may be rifled (not shown) to impart rotation to a bullet (not shown) fired therethrough. The piston 810*p* may include a recess formed therein in fluid communication with the exhaust sub-chamber. One or more ports 810*h* may be formed through a wall of the piston 810*p* and may provide fluid communication between the channel 815*c* and the piston recess.

In operation, as the bullet passes the gas port 805*p* in the barrel 805, and before the bullet exits the barrel, the exhaust sub-chamber becomes pressurized from the expanding gas of the fired cartridge via (port 805*p*, channel 815*c*, and ports 810*h*). The pressurized exhaust gas forces the piston 810*p* to the rear of the piston chamber or "full stroke" position. The operating rod 810*r* pushes on the bolt carrier key (see FIG. 9), which then moves the bolt carrier to the rear, unlocking the bolt and cycling the rifles action. As the bolt carrier is forced to the rear, it compresses the rifles main operating spring (buffer spring). Air in the air sub-chamber is vented to the atmosphere via the ports 820*p*.

Once the bullet has exited the muzzle or flash suppressor and the pressure in the rifle bore decreases, the piston/rod assembly 810 is pushed back to the forward or "resting position" by the expanding buffer spring. As the bolt and bolt carrier continue forward, the bolt carrier is returned all the way to the forward position, locking the bolt. The residual gas in the piston chamber is exhausted back into the barrel through the gas channel 815*c* and gas port 805*p*. The firing sequence is now complete, and the rifle is now ready to fire again. The gas piston system 800 keeps exhaust gas near the front end of the gun and in the barrel instead of discharging the gas into the upper receiver as the conventional M16/AR15 gas impingement system does.

Alternatively, the gas piston system may be incorporated into the front sight. Alternatively, the ports 810*h* may be omitted and the channel 815*c* may be in direct fluid communication with the piston recess. Alternatively, the ports 810*h* may be omitted, a primary channel may be in direct fluid communication with the piston recess and an auxiliary gas channel may be in fluid communication with the exhaust sub-chamber when the piston is in the full stroke position, thereby aiding venting of the exhaust gas into the barrel and accelerating return of the piston to the at-rest position.

While the foregoing is directed to embodiments of the present invention, other and further embodiments of the invention may be devised without departing from the basic scope thereof, and the scope thereof is determined by the claims that follow.

Figure 3A:
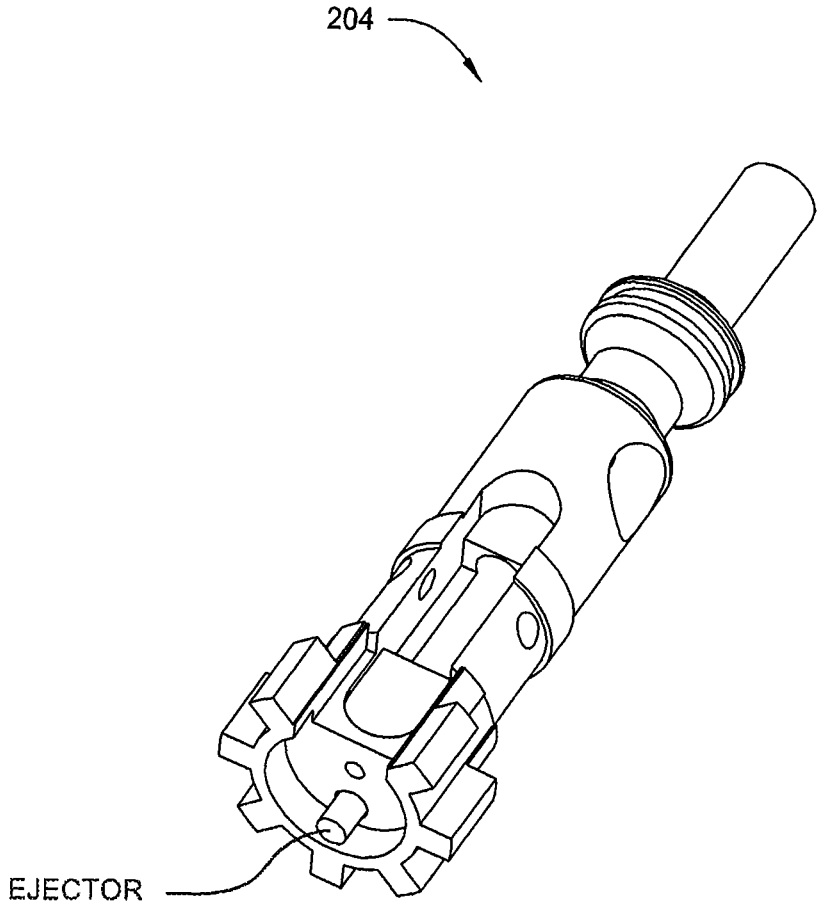
Figure 3C:
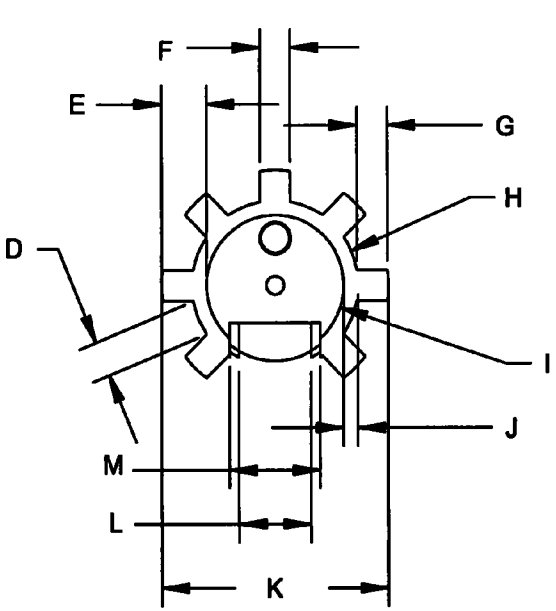
Figure 3B:
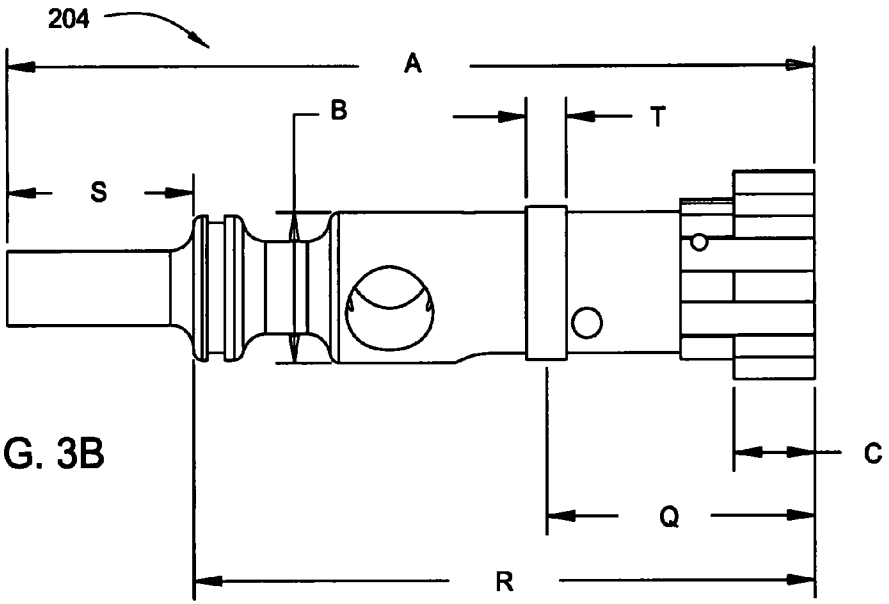
Figure 3D:
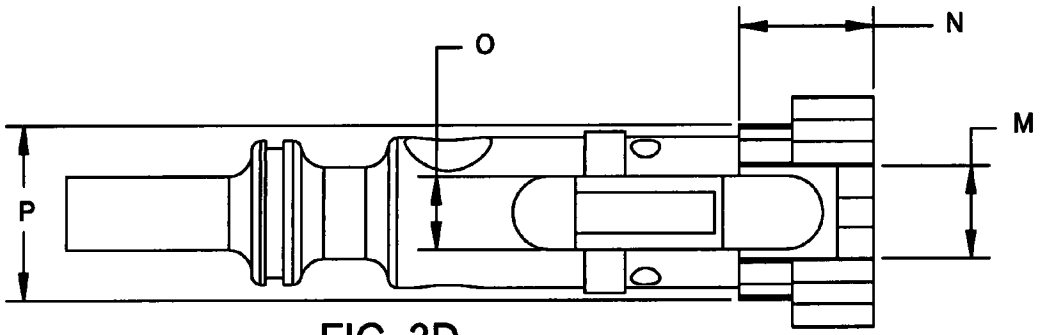
Figure 4A:
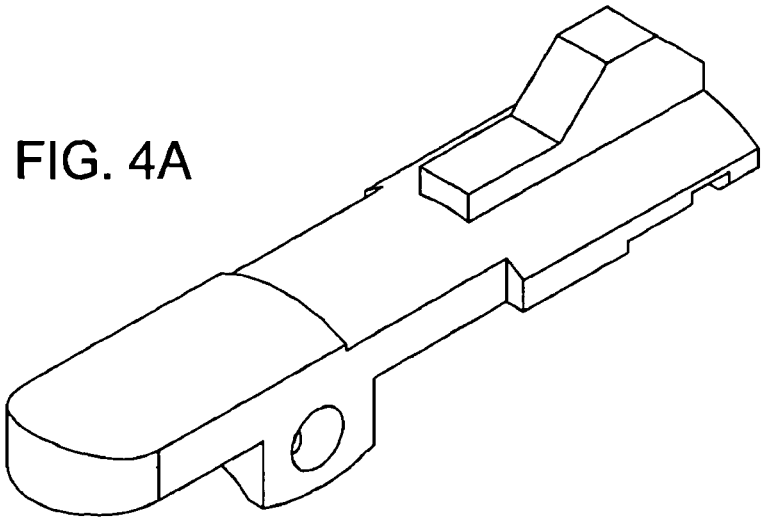
Figure 4B:
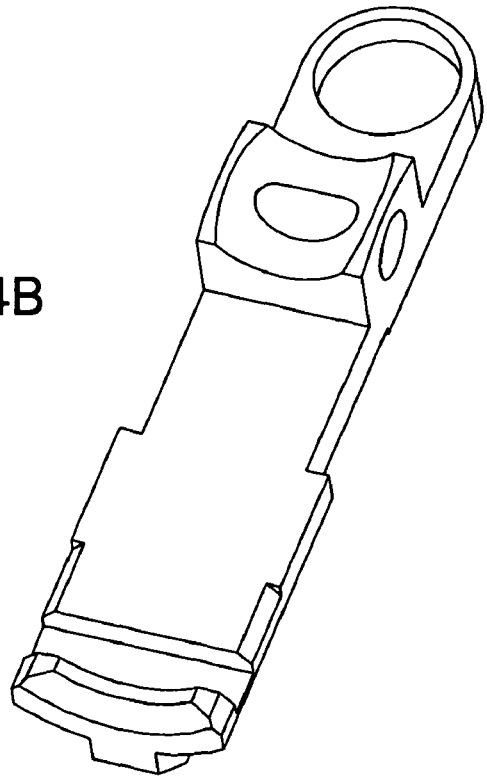
Figure 4D:
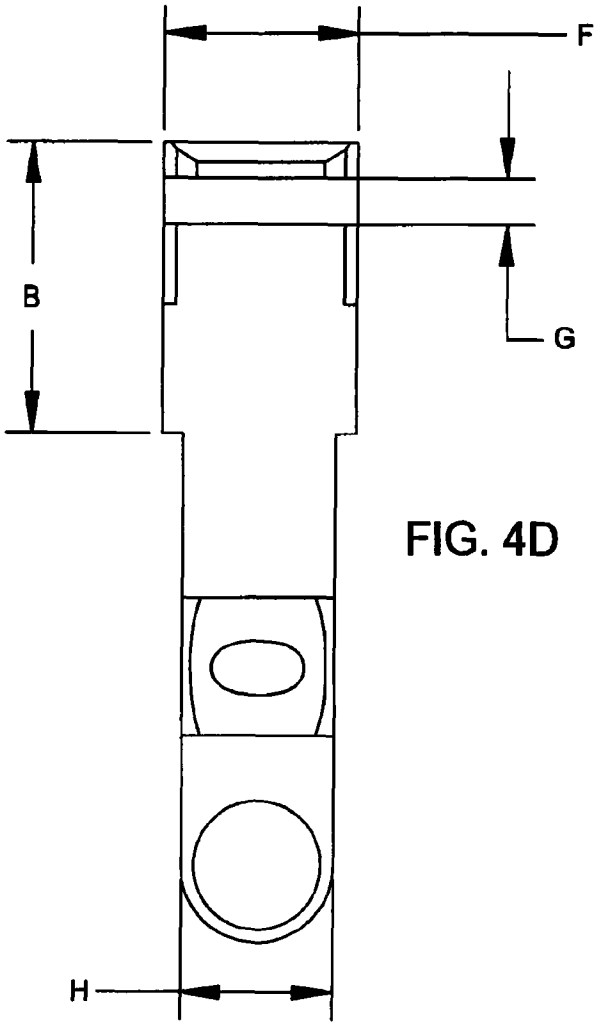
Figure 4C:
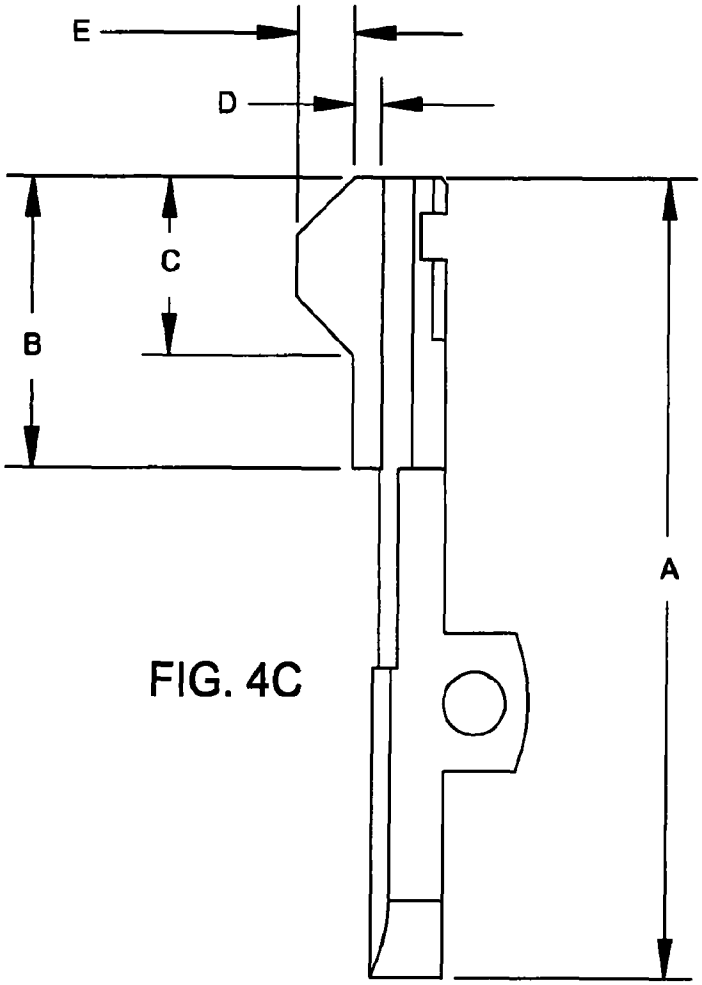

What is claimed is:

1. A modified M16 rifle or M4 carbine, comprising:
- a bolt having a maximum outside diameter (K in FIG. 3C) greater than that of a standard M16/M4 bolt (existing M16A1-A4 versions and M4 and M4A1 versions);
- an ejector carried by the bolt;
- a bolt extractor pivoted to the bolt and having a maximum width (F in FIG. 4D) greater than that of a standard M16/M4 bolt extractor (existing M16A1-A4 versions and M4 and M4A1 versions),
- wherein:
  - the bolt, the ejector, and the bolt extractor operable to: transport a cartridge from a magazine to a barrel, and eject a spent cartridge from the barrel,
  - a length of the cartridge is equal to or slightly less than 2.26 inches, and the cartridge comprises:
    - a case having a case head diameter greater than 0.378 inch; and
    - a bullet having a diameter greater than or equal to 0.224 inch;
- a barrel extension configured to receive the bolt;
- a standard M16/M4 upper receiver (existing M16A1-A4 versions and M4 and M4A1 versions) coupled to the barrel extension; and
- a standard M16/M4 lower receiver (existing M16A1-A4 versions and M4 and M4A1 versions) coupled to the upper receiver.

2. The rifle or carbine of claim 1, wherein the case head diameter is greater than or equal to 0.4 inch.

3. The rifle or carbine of claim 2, wherein the bullet diameter is greater than or equal to 6 mm.

4. The rifle or carbine of claim 2, wherein the bullet diameter is greater than or equal to 6.5 mm.

5. The rifle or carbine of claim 2, wherein the bullet diameter is greater than or equal to 6.8 mm.

6. The rifle or carbine of claim 1, wherein the case head diameter is greater than or equal to 0.425 inch.

7. The rifle or carbine of claim 1, wherein the case head diameter is greater than or equal to 0.45 inch.

8. The rifle or carbine of claim 1, further comprising the magazine configured to hold a plurality of the cartridges.

9. The rifle or carbine of claim 1, further comprising the barrel configured to receive the cartridge and connected to the barrel extension.

10. The rifle or carbine of claim 1, wherein the bolt has an inside diameter (I in FIG. 3C) greater than that of the standard M16/M4 bolt.

Figure 5A:
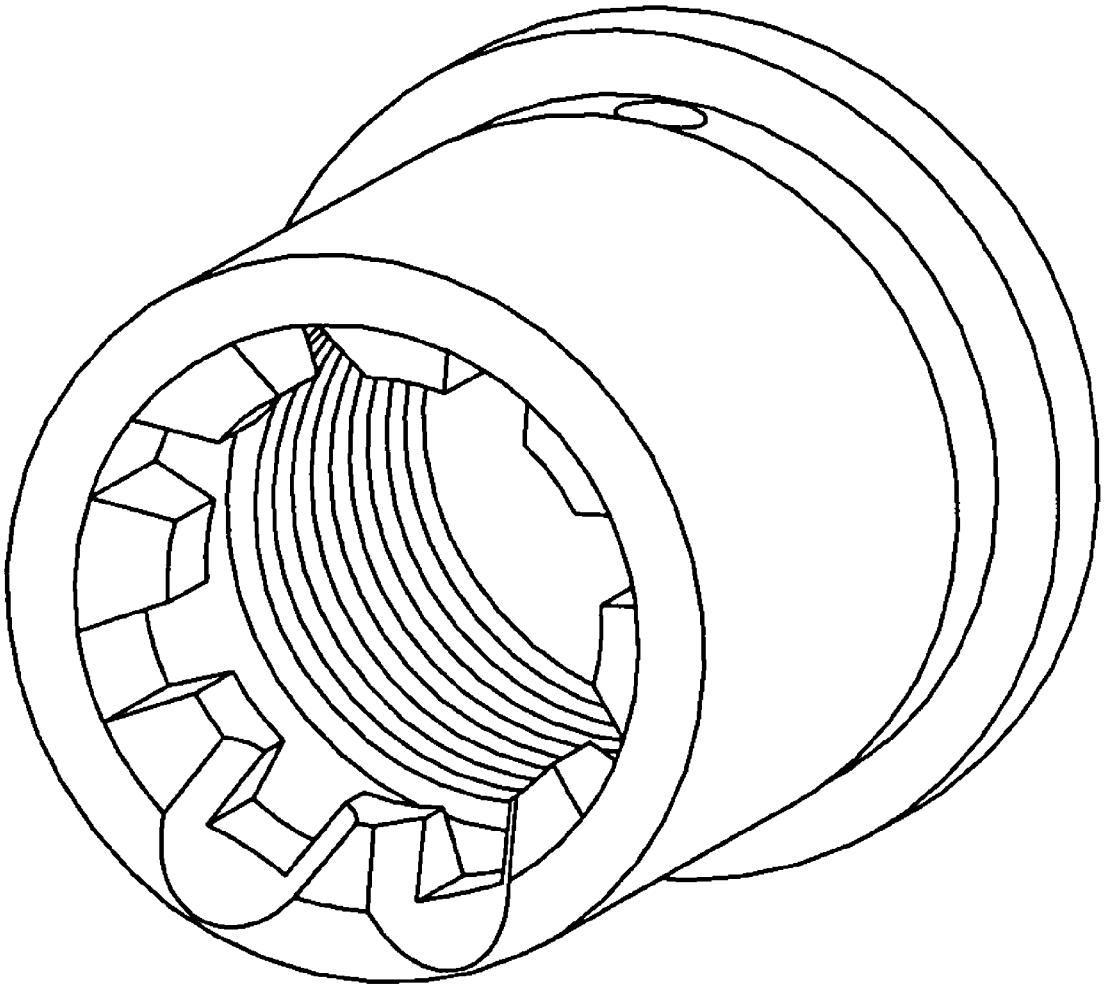
Figure 5C:
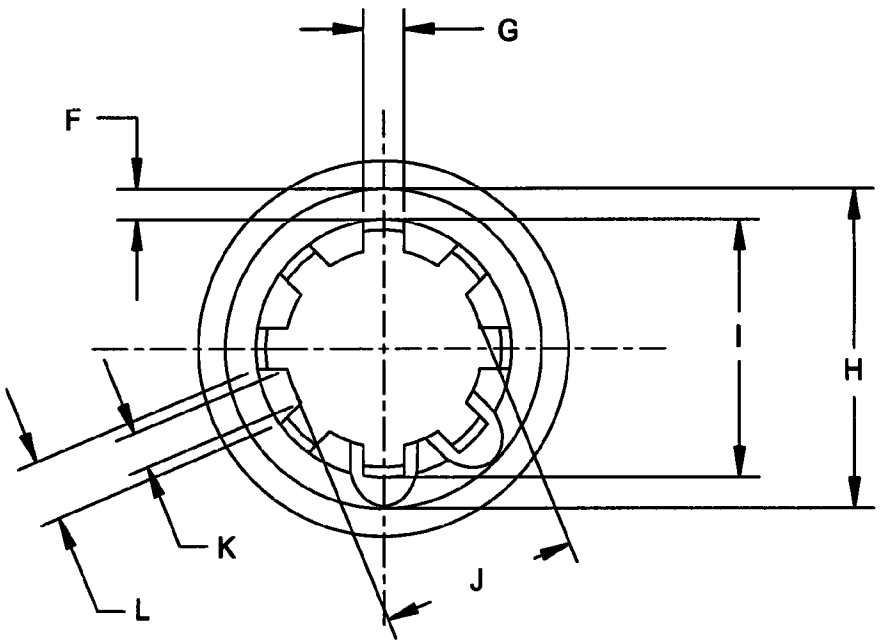
Figure 5B:
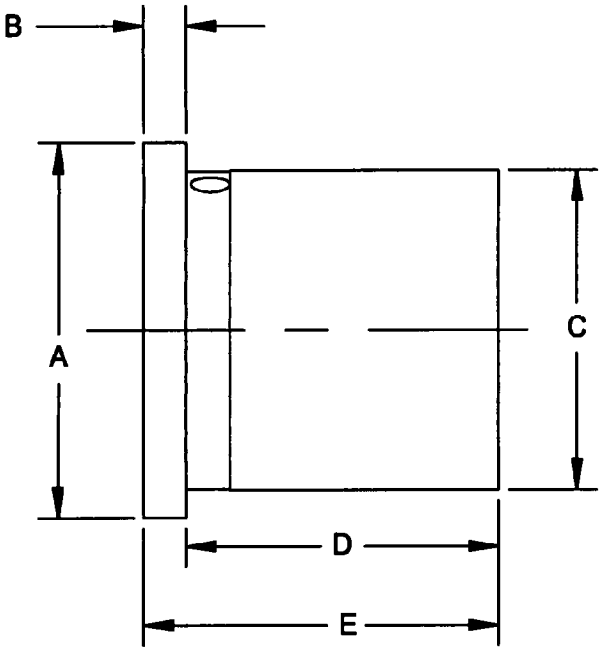
Figure 6A:
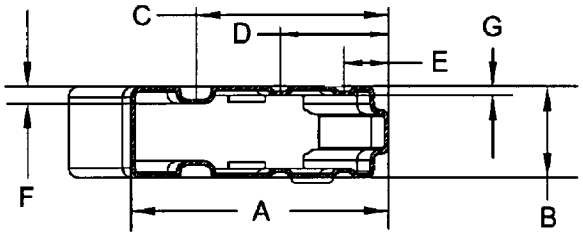
Figure 6C:
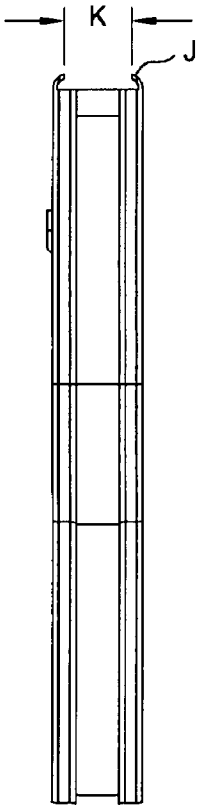
Figure 6B:
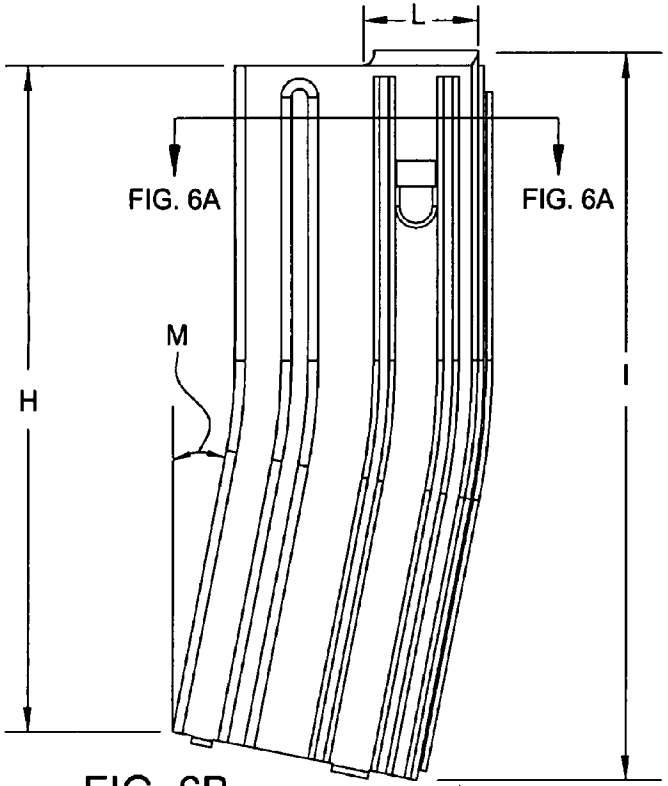
Figure 6D:
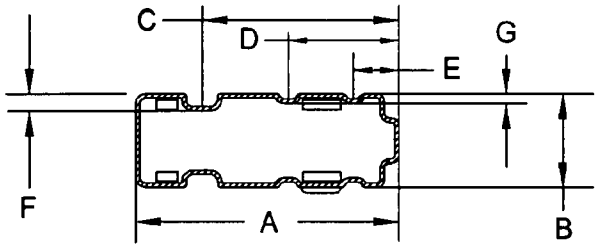
Figure 6E:
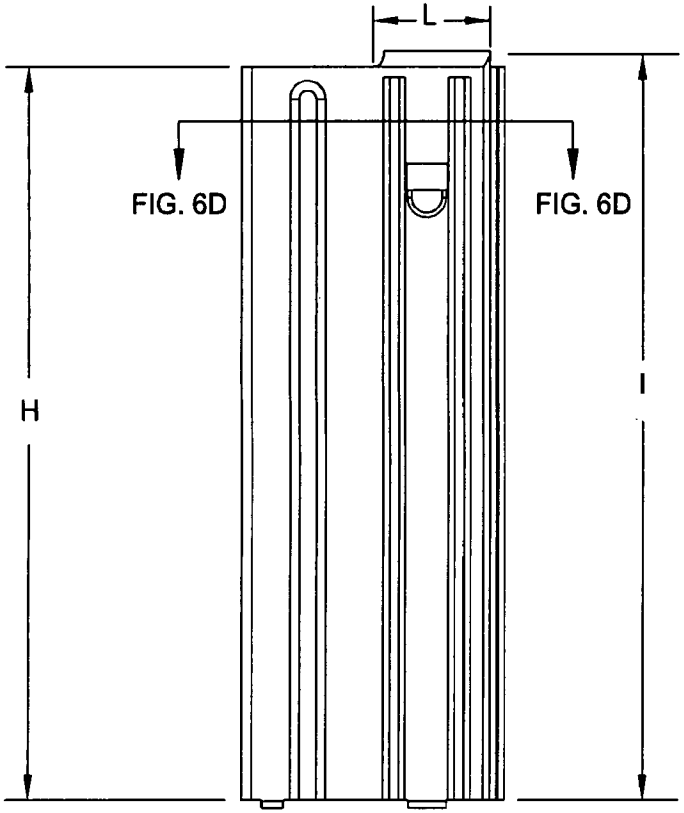
Figure 6F:
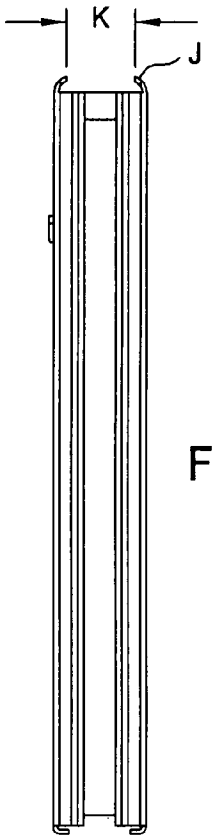
Figure 7A:
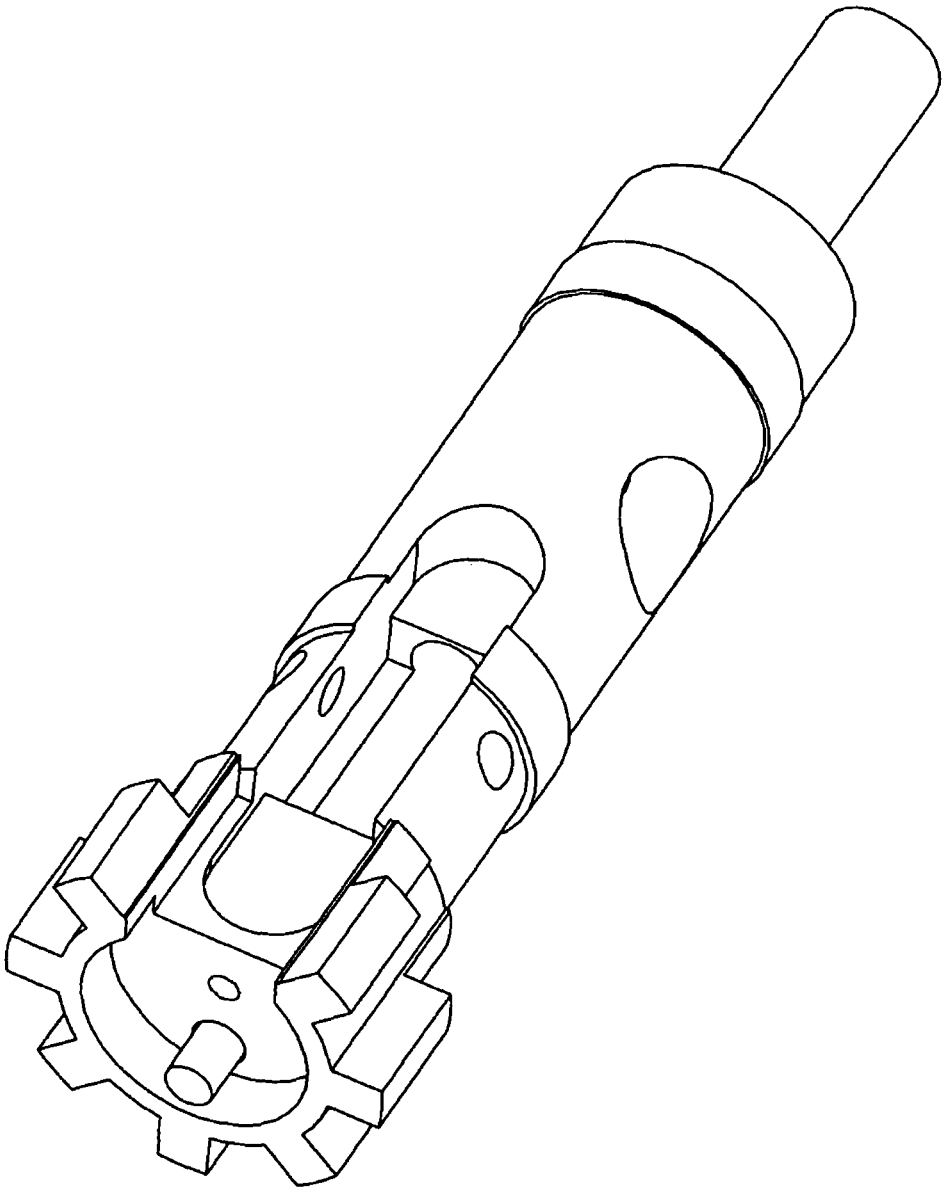
FIGS. 7A-7D illustrate details of a bolt usable with the cartridges of FIGS. 1A-1C and a modified gas piston system, according to another embodiment of the present invention.
Figure 7C:
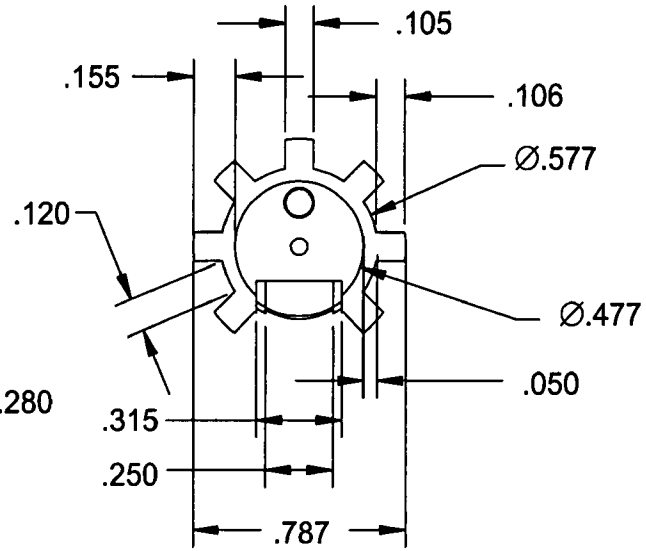
Figure 7B:
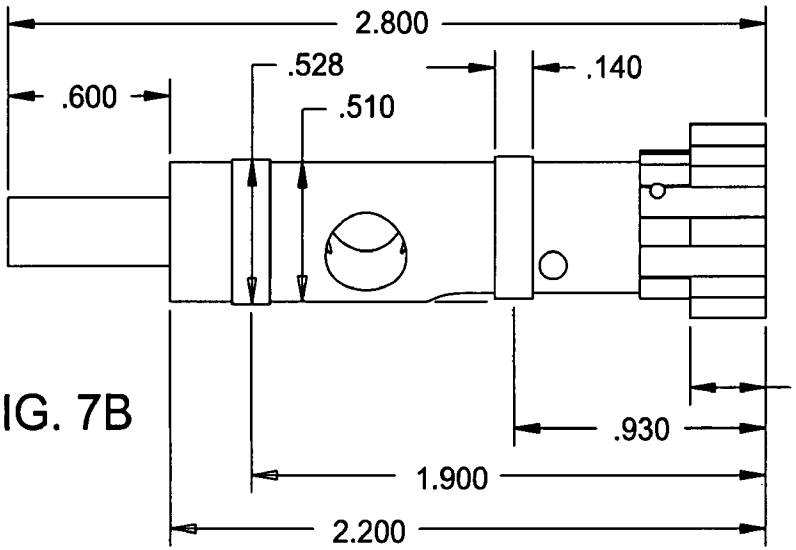
Figure 7D:
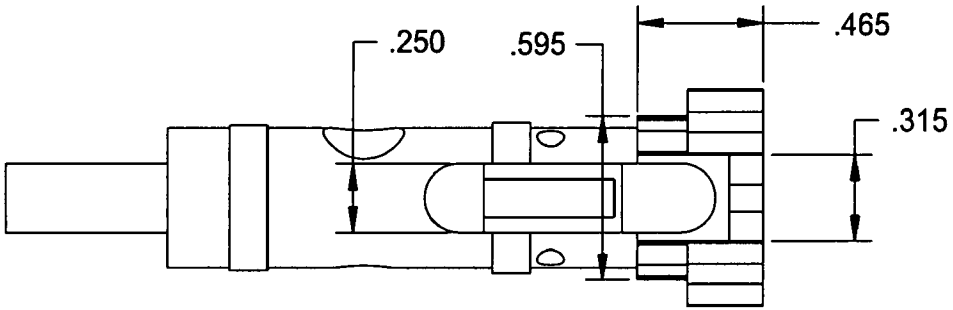

11. The rifle or carbine of claim 10, wherein the barrel extension has a maximum inside diameter (I in FIG. 5C) greater than that of a standard M16/M4 barrel extension (existing M16A1-A4 versions and M4 and M4A1 versions).

12. The rifle or carbine of claim 11, wherein:
- the bolt has an outer diameter (H in FIG. 3C) greater than that of the standard M16/M4 bolt, and
- the barrel extension has an inner diameter (J in FIG. 5C) greater than that of the standard M16/M4 barrel extension.

13. A modified M16 rifle or M4 carbine, comprising:
- a bolt having a maximum outside diameter (K in FIG. 3C) and an inside diameter (I in FIG. 3C) greater than those of a standard M16/M4 bolt (existing M16A1-A4 versions and M4 and M4A1 versions);
- an ejector carried by the bolt;
- a bolt extractor pivoted to the bolt,
- wherein:
  - the bolt, the ejector, and the bolt extractor operable to: transport a cartridge from a magazine to a barrel, and eject a spent cartridge from the barrel,
  - a length of the cartridge is equal to or slightly less than 2.26 inches, and the cartridge comprises:
    - a case having a case head diameter greater than 0.378 inch; and
    - a bullet having a diameter greater than or equal to 0.224 inch;
- a barrel extension having a maximum inside diameter (I in FIG. 5C) greater than that of a standard M16/M4 barrel extension (existing M16A1-A4 versions and M4 and M4A1 versions) for receiving the bolt;
- a standard M16/M4 upper receiver (existing M16A1-A4 versions and M4 and M4A1 versions) coupled to the barrel extension; and
- a standard M16/M4 lower receiver (existing M16A1-A4 versions and M4 and M4A1 versions) coupled to the upper receiver.

14. The rifle or carbine of claim 13, wherein:
- the bolt has an outer diameter (H in FIG. 3C) greater than that of the standard M16/M4 bolt, and
- the barrel extension has an inner diameter (J in FIG. 5C) greater than that of the standard M16/M4 barrel extension.

15. The rifle or carbine of claim 13, wherein:

the case head diameter is greater than or equal to 0.4 inch, and the bullet diameter is greater than or equal to 6 mm.

* * * * *